US011364413B2

(12) United States Patent
Shiang et al.

(10) Patent No.: US 11,364,413 B2
(45) Date of Patent: Jun. 21, 2022

(54) REACTION FORCE DETECTION SYSTEM FOR TREADMILLS AND DETECTION METHOD THEREOF

(71) Applicant: NATIONAL TAIWAN NORMAL UNIVERSITY, Taipei (TW)

(72) Inventors: Tzyy-Yuang Shiang, Taipei (TW); Wen-Wen Yang, Taipei (TW); Wei-Han Chen, Taipei (TW); En-Tzu Wang, Taipei (TW)

(73) Assignee: NATIONAL TAIWAN NORMAL UNIVERSITY, Taipei (TW)

( * ) Notice: Subject to any disclaimer, the term of this patent is extended or adjusted under 35 U.S.C. 154(b) by 275 days.

(21) Appl. No.: 16/879,915

(22) Filed: May 21, 2020

(65) Prior Publication Data

US 2020/0376330 A1 Dec. 3, 2020

(30) Foreign Application Priority Data

May 30, 2019 (TW) ..... 108118792

(51) Int. Cl.
*A63B 22/02* (2006.01)
*A63B 69/00* (2006.01)
*A63B 24/00* (2006.01)

(52) U.S. Cl.
CPC ..... *A63B 22/025* (2015.10); *A63B 24/0087* (2013.01); *A63B 69/0028* (2013.01); *A63B 2024/0093* (2013.01)

(58) Field of Classification Search
None
See application file for complete search history.

(56) References Cited

U.S. PATENT DOCUMENTS

2011/0312473 A1* 12/2011 Chu ..... A63B 22/0292 482/54
2018/0345070 A1* 12/2018 Yakovenko ..... A63B 22/0292

FOREIGN PATENT DOCUMENTS

WO WO-2019030687 A1 * 2/2019 ..... A63B 22/0235

OTHER PUBLICATIONS

"Nakashima et al., Treadmill Motor Current Based Anteroposterior Force Estimation Using Ground Reaction Force Approximation Depending on Gait Cycle, 2011, IEEE, 1583-1589" (Year: 2011).*
"Nakashima et al., Treadmill Motor Current Based Real-time Estimation of Anteroposteior Force during Gait, 2010, IEEE, 475-478" (Year: 2010).*

(Continued)

*Primary Examiner* — Sundhara M Ganesan
*Assistant Examiner* — Shila Jalalzadeh Abyaneh
(74) *Attorney, Agent, or Firm* — WPAT, PC

(57) ABSTRACT

A reaction force detection system for treadmills and detection method thereof is disclosed, wherein the system detects the current data generated by a user running on a treadmill comprising a running belt, a motor and an electronic circuit device by means of a current sensor, and then determines a current peak based on the current data, such that a ground reaction force peak can be determined according to the acquired current peak. Therefore, the present invention allows to determine the ground reaction force of the human body during running through the changes of the motor current signals inside the treadmill, such that these parameters can be further presented, analyzed, and stored in order to provide more scientific feedbacks for running trainings.

6 Claims, 8 Drawing Sheets

(56) References Cited

OTHER PUBLICATIONS

"Nakashima et al., Development of a Novel Gait Rehabilitation System by integrating Functional Electrical Stimulation and a Split Belt Treadmill for Hemiparetic Patients after Stroke, 2014, IEEE, 701-706" (Year: 2014).*

* cited by examiner

REACTION FORCE DETECTION SYSTEM FOR TREADMILLS AND DETECTION METHOD THEREOF

BACKGROUND OF THE INVENTION

1. Field of the Invention

The present invention generally relates to a reaction force detection system for treadmills and detection method thereof; in particular, it is about a system and the method thereof capable of determining the ground reaction force during running based on the variations of motor current signals.

2. Description of Related Art

In recent years, fitness and running sports are quite popular, and many organizations also organize various types of jogging activities such that people can participate and enjoy jogging outdoors. However, due to some factors, e.g., climate, weather etc., in case it is raining, cold, haze or the like in the open environment, it may be very unsuitable for outdoor running, so a lot of people may choose to use treadmills for indoor fitness purposes, and many large-scaled fitness locations may also install massive treadmills in the venue for customers to use.

Additionally, in the past, in order to obtain dynamic parameters during running, it is often necessary to rely on sophisticated and expensive instruments (e.g., high-speed cameras, force measurement boards, sole pressure insoles, etc.). However, these tools are not only inconvenient to apply, but the output data needs to be professionally processed so as to acquire the intended movement characteristics, and then can be further translated into dynamic parameters having actual application values by the interpretations of the professional sport science staff, and such entire processes may be very time-consuming and take significant amount of efforts. Moreover, due to the professional threshold thereof, it may be quite difficult to promote to public people, and often cannot provide real-time feedback in the moment of sports.

Therefore, compared to conventional methods, if the electric current information from the treadmill itself can be acquired and built-in analysis devices can operate conjunctively, it is possible to obtain dynamic parameters having application values and allow them to be real-time output during user's exercises, thus that the present invention provides an optimal solution.

SUMMARY OF THE INVENTION

The reaction force detection system for treadmills according to the present invention comprises a treadmill including a running belt, a motor and an electronic circuit device electrically connected to the motor, in which the electronic circuit device has: one or more current sensors, which are applied to detect the current data generated by a user running on the running belt; a central processing electronic circuit assembly, which is connected to the current sensor and able to receive the current data, wherein the central processing electronic circuit assembly internally includes: a current peak recording unit, which is applied to extract a current peak based on the highest point of each cycle in the acquired current data; a reaction force peak calculation unit, which is connected to the current peak recording unit so as to determine a vertical ground reaction force peak by means of the current peak; a transmission electronic circuit assembly, which is connected to the central processing electronic circuit assembly so as to transmit the data obtained from the calculations completed by the central processing electronic circuit assembly; and an electronic carrier, which can be connected to the electronic circuit device thereby receiving data calculated by the central processing electronic circuit assembly of the treadmill.

More specifically, the reaction force peak calculation unit is further able to determine a horizontal ground reaction force peak from the vertical ground reaction force peak based on a ratio of the vertical force to the horizontal force.

More specifically, the electronic carrier is a handheld smart device, a tablet computer, a desktop computer, a panel or a notebook computer.

A reaction force detection method for treadmills, comprising:

(1) detecting the current data generated by a user running on a treadmill comprising a running belt, a motor and an electronic circuit device through a current sensor;

(2) determining the highest point of each cycle in the current data as a current peak;

(3) subsequently, determining a vertical ground reaction force peak based on the current peak;

(4) finally, transmitting the data calculated by the treadmill to an electronic carrier.

More specifically, it is further able to determine a horizontal ground reaction force peak from the vertical ground reaction force peak based on a ratio of the vertical force to the horizontal force.

More specifically, the electronic carrier is a handheld smart device, a tablet computer, a desktop computer, a panel or a notebook computer.

DETAILED DESCRIPTION OF THE PREFERRED EMBODIMENTS

Other technical contents, aspects and effects in relation to the present invention can be clearly appreciated through the detailed descriptions concerning the preferred embodiments of the present invention in conjunction with the appended drawings.

Figure 1A:
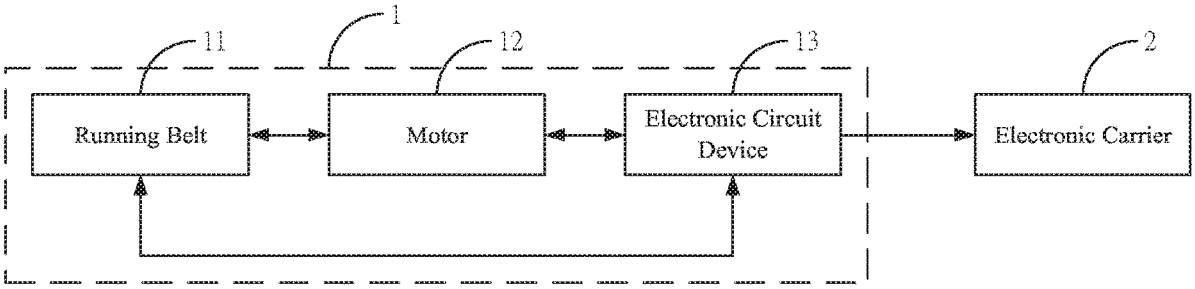
FIG. 1A shows an integral architecture view of the reaction force detection system for treadmills and detection method thereof according to the present invention.
Figure 1B:
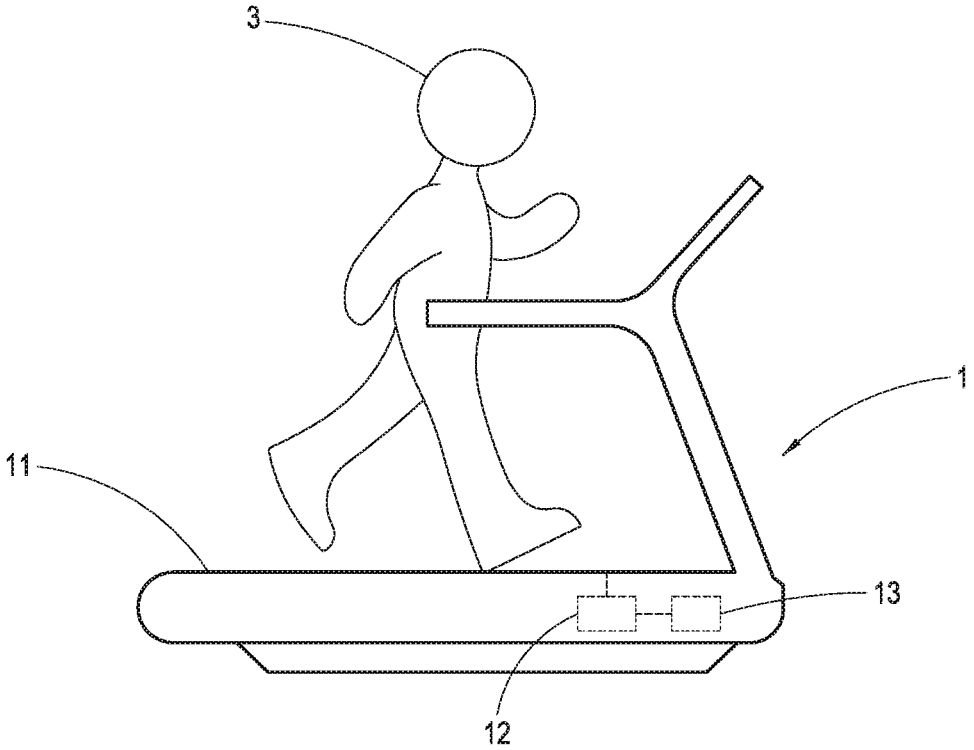
FIG. 1B shows a treadmill implementation view of the reaction force detection system for treadmills and detection method thereof according to the present invention.

Refer first to FIGS. 1A and 1B, wherein an integral architecture view and a treadmill implementation view of the reaction force detection system for treadmills and detection method thereof according to the present invention are respectively shown. It can be observed from such Figures that the present system comprises a treadmill 1 and an electronic carrier 2, wherein the treadmill 1 has a running belt 11, a motor 12, and a electronic circuit device 13 electrically connected to the running belt 11 and the motor 12, and the electronic circuit device 13 can receive data generated by a runner 3 running on the treadmill 1 and then transmit the received data to an electronic carrier 2, which may be, for example, a handheld smart device, a tablet computer, a desktop computer, a panel or a laptop computer or the like.

Figure 2:
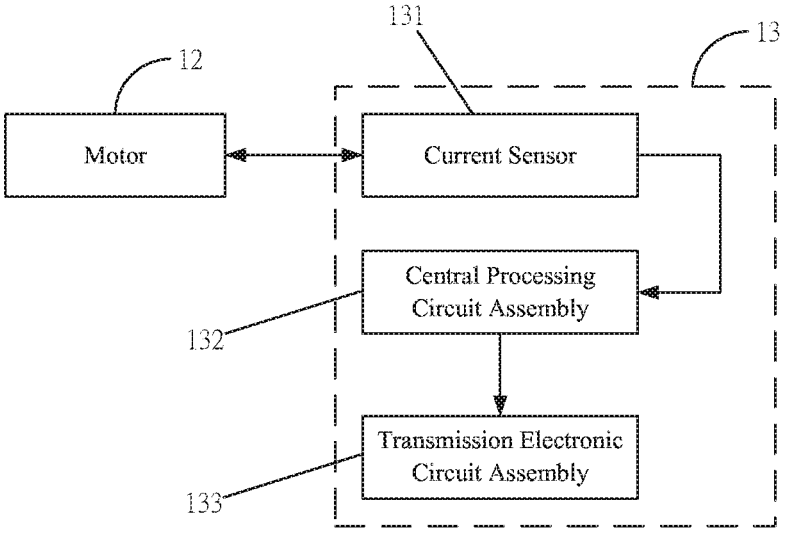
FIG. 2 shows an implementation architecture view of the electronic circuit device in the reaction force detection system for treadmills and detection method thereof according to the present invention.

Next, as shown in FIG. 2, the electronic circuit device 13 is composed of one or more circuit boards, and the circuit boards of the electronic circuit device 13 are provided with one or more current sensors 131, a central processing electronic circuit assembly 132 and a transmission electronic circuit assembly 133, wherein the current sensor 131 can be applied to detect the current data generated by the motor 12 when the user is running on the running belt 11, and the transmission electronic circuit assembly 133 is to transmit the calculated data obtained from the central processing electronic circuit component 132 (alternatively, the sensor can be also configured not within the electronic circuit device 13 but instead directly in the treadmill 1, and the detected data can be transmitted to the electronic circuit device 13 for subsequent processes).

Figure 3:
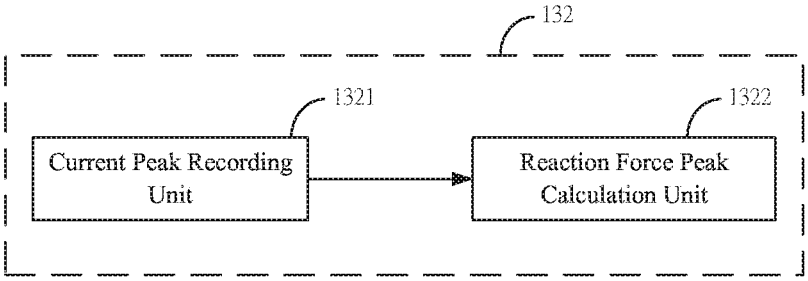
FIG. 3 shows an architecture view of the central processing electronic circuit assembly in the reaction force detection system for treadmills and detection method thereof according to the present invention.

Moreover, it can be seen from FIG. 3 that the central processing electronic circuit component 132 can receive the current data, wherein the central processing electronic circuit component internally has a current peak recording unit 1321 and a reaction force peak calculation unit 1322, and the current peak recording unit 1321 can take a current peak according to the highest point in each cycle of the current data.

Besides, the reactive force peak calculation unit 1322 is used to determine a vertical ground reaction force peak through the obtained current peak, and then further capable of determining a horizontal ground reaction force peak with the determined vertical ground reaction force peak by means of a ratio of the vertical force to the horizontal force.

It should be appreciated that, upon running on a treadmill, the human body exerts a force on the running belt, which force can be divided into a vertical orientation and a horizontal orientation, and the running belt 11 of the treadmill 1 is driven by the motor 12 and rotates at a speed maintained by the input of the treadmill, so that the vertical force caused by the human body to the treadmill 1 will increase the frictional force when the running belt 11 rotates, and, at this time, the current of the motor 12 will rise so as to maintain the same speed.

Figure 4:
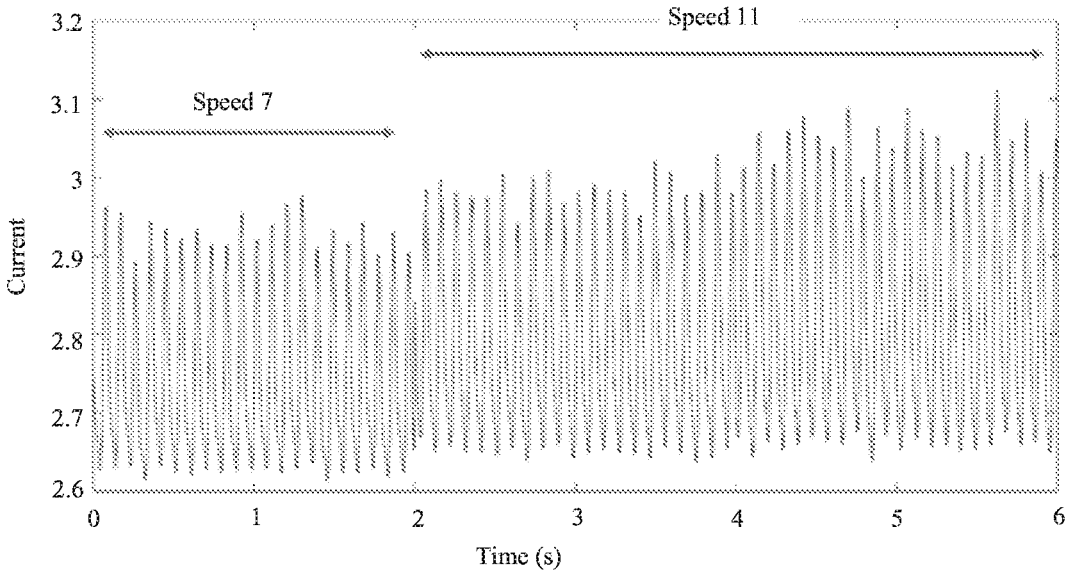
FIG. 4 shows a view of current detections under different speeds with the reaction force detection system for treadmills and detection method thereof according to the present invention.
Figure 5:
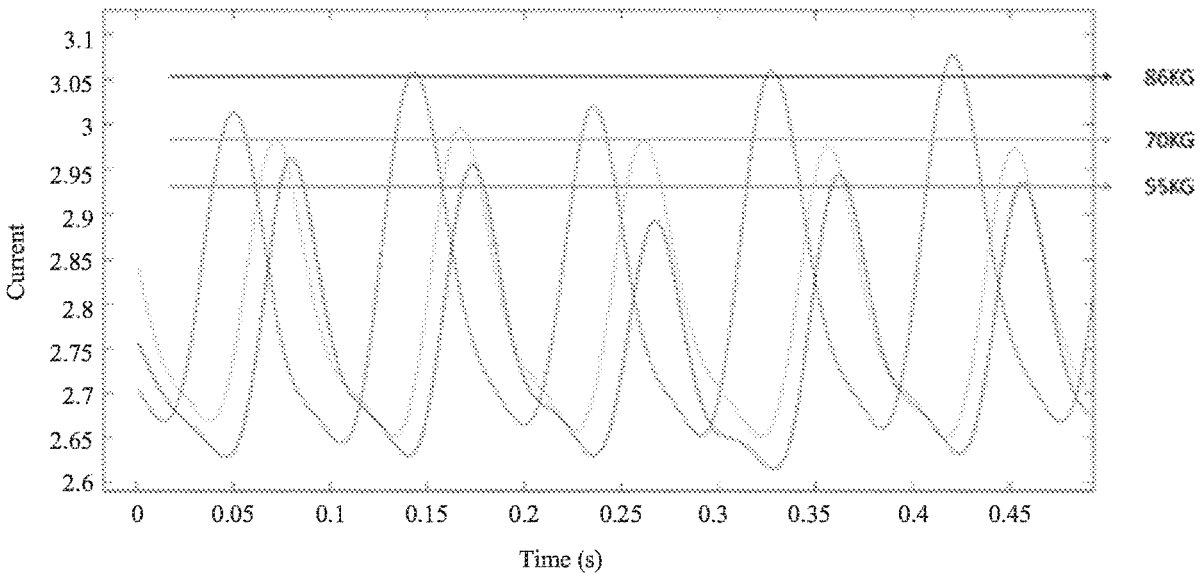
FIG. 5 shows a view of current comparisons between runners having different weights with the reaction force detection system for treadmills and detection method thereof according to the present invention.

As the speed of running becomes faster or the weight of the runner is heavier, the resulting action force will be greater, so the peak current will be higher. As shown in FIGS. 4 and 5, according to Newton's third law of motion, the ground will provide back the reaction force of equal amount in an opposite direction, which means the vertical ground reaction force and the horizontal ground reaction force, so we can determine the vertical ground reaction force peak based on the current peak values. The ground reaction force peak value can be derived by the empirical formula, as described below.

Figure 6:
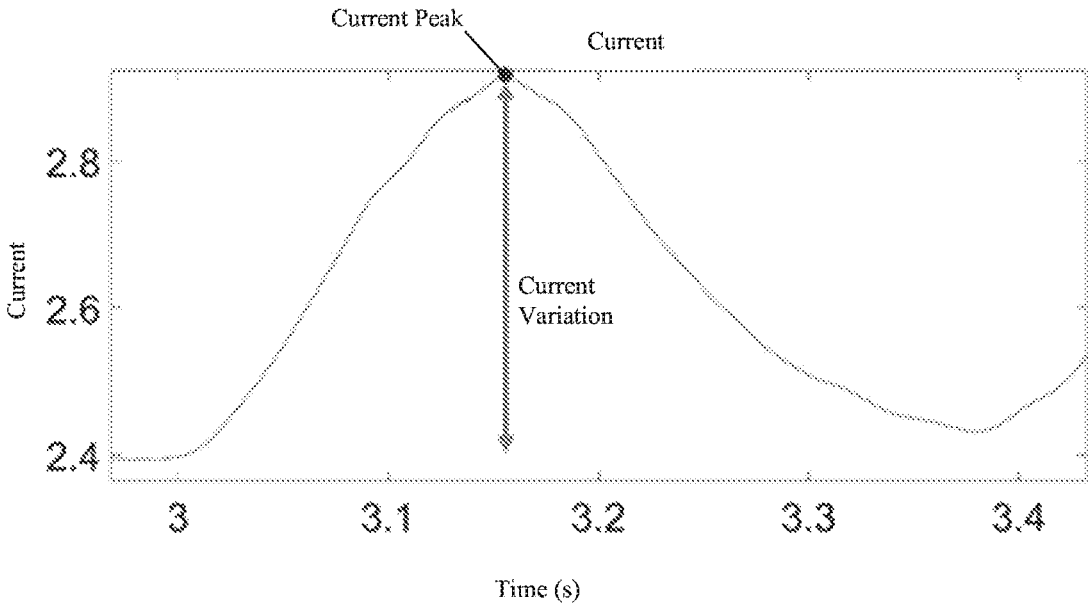
FIG. 6 shows a view of within-one-step current detections with the reaction force detection system for treadmills and detection method thereof according to the present invention.

By referring to FIG. 6, these two kinds of ground reaction force peaks can be illustrated in details, as follows:

(1) Vertical Ground Reaction Force Peak:

The vertical ground reaction force peak can be calculated from the current peak and an adjustment constant, whose calculation method first uses a regression equation as the basis to make minor adjustments, and further because the vertical ground reaction force peak is positively correlated with the current peak, regression analyses can be performed on the current data in conjunction with force signals measured by other instruments, thus getting the following relation:

$$F_{ver}=C_p*A_p+C_C$$

herein $F_{ver}$ indicates the vertical ground reaction force, $C_p$ the current peak coefficient, $C_c$ the adjustment constant, and $A_p$ current peak; therefore, for example, when a runner is running thereon, the maximum value (peak) of the measured current is 2.95 A, and the calculated vertical ground reaction force peak will be 921.93*2.95+(−2280.94)=438.75 N.

(2) Horizontal Ground Reaction Force Peak:

The horizontal ground reaction force peak can be obtained by applying an empirical formula, and the estimated value can be derived via the ratio of the vertical force and the horizontal force of the runner at that speed in the past. More specifically, according to past literatures and researches, the horizontal ground reaction force peak usually accounts for a quarter of the vertical ground reaction force, so that, after previously calculating the vertical ground force peak, the horizontal ground reaction force peak can be estimated in such a proportion. Therefore, continuing the above example, the horizontal ground reaction force peak will be 438.75*¼=109.68 N.

Figure 7:
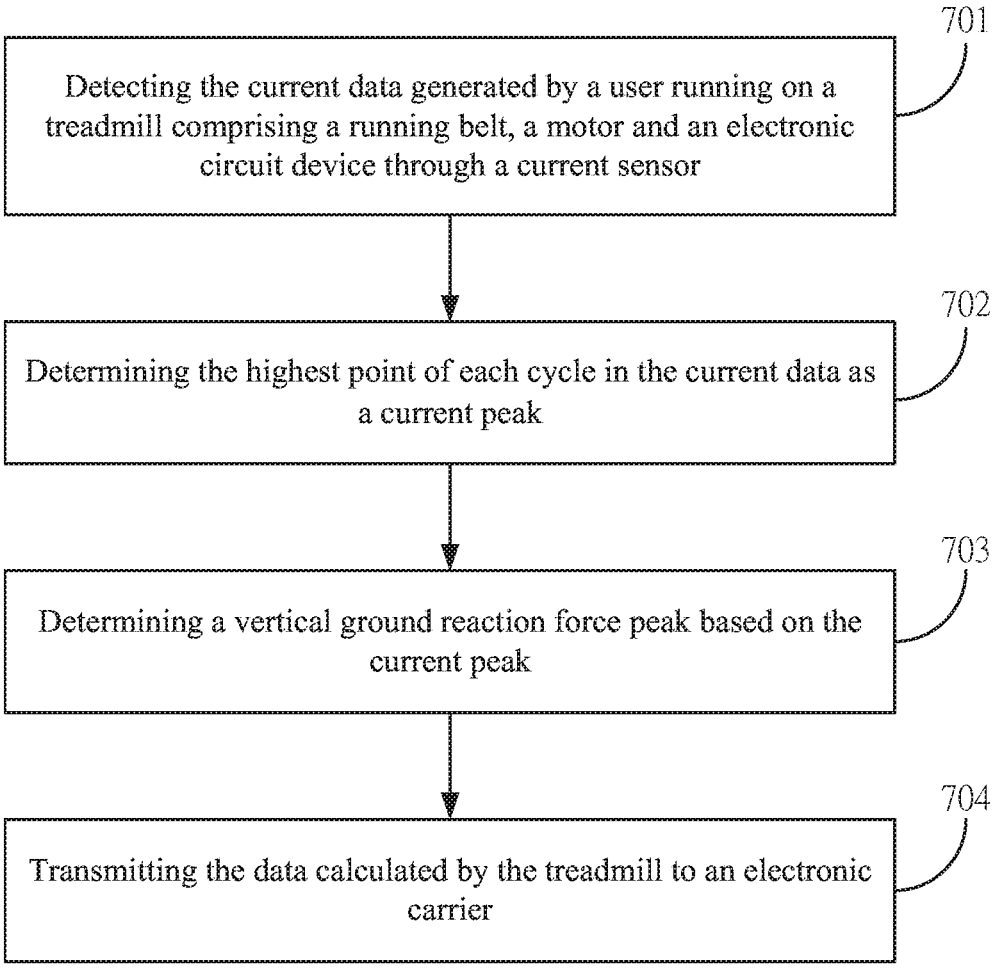
FIG. 7 shows a flowchart of the detection method in the reaction force detection system for treadmills and detection method thereof according to the present invention.

Furthermore, a detection method flowchart is shown in FIG. 7, and steps thereof are described in details as below:

(1) detecting the current data generated by a user running on a treadmill comprising a running belt, a motor and an electronic circuit device through a current sensor (701);

(2) determining the highest point of each cycle in the current data as a current peak (702);

(3) subsequently, determining a vertical ground reaction force peak based on the current peak (703);

(4) finally, transmitting the data calculated by the treadmill to an electronic carrier (704).

Compared with other prior arts, the reaction force detection system for treadmills and detection method thereof according to the present invention provides the following advantages:

(1) The present invention can capture the current information of the treadmill itself and operate in conjunction with the built-in analysis devices to output in real-time dynamic parameters having application values during a user's sport time.

(2) Upon obtaining the desired dynamic parameters, the present invention needs not to neither rely on external or additional instruments nor professional sport-science staffs for post analyses, but simply to first obtain the electrical current information of the treadmill itself, then, based on the data, it is possible to determine various dynamic parameters which are commonly used in scientific running supervising and training processes.

It should be noticed that, although the present invention has been disclosed through the detailed descriptions of the aforementioned embodiments, such illustrations are by no means used to restrict the scope of the present invention; that is, skilled ones in relevant fields of the present invention can certainly devise any applicable alterations and modifications after having comprehended the aforementioned technical characteristics and embodiments of the present invention without departing from the spirit and scope thereof. Hence, the scope of the present invention to be protected under patent laws should be delineated in accordance with the claims set forth hereunder in the present specification.

What is claimed is:

1. A reaction force detection system for treadmills, comprising:

a treadmill, including a running belt, a motor and an electronic circuit device electrically connected to the motor, in which the electronic circuit device has:

one or more current sensors, which are applied to detect the current data generated by a user running on the running belt;

a central processing electronic circuit assembly, which is connected to the one or more current sensors and able to receive the current data, wherein the central processing electronic circuit assembly configured to:

extract a current peak based on the highest point of each cycle in the acquired current data; and determine a vertical ground reaction force peak using the current peak;

a transmission electronic circuit assembly, which is connected to the central processing electronic circuit assembly so as to transmit the vertical ground reaction force peak obtained from the calculations completed by the central processing electronic circuit assembly;

an electronic carrier, which can be connected to the electronic circuit device thereby receiving data calculated by the central processing electronic circuit assembly of the treadmill.

2. The reaction force detection system for treadmills according to claim 1, wherein the central processing electronic circuit assembly is further configured to determine a horizontal ground reaction force peak from the vertical ground reaction force peak based on a ratio of vertical force to horizontal force.

3. The reaction force detection system for treadmills according to claim 1, wherein the electronic carrier is a handheld smart device, a tablet computer, a desktop computer, a panel or a notebook computer.

4. A reaction force detection method for treadmills, comprising:

detecting, through a current sensor, motor current data generated by a user running on a treadmill comprising a running belt, a motor and an electronic circuit device;

determining the highest point of each cycle in the motor current data as a current peak;

determining a vertical ground reaction force peak using the current peak; and transmitting the vertical ground reaction force peak calculated by the treadmill to an electronic carrier.

5. The reaction force detection method for treadmills according to claim 4, further comprising determining a horizontal ground reaction force peak from the vertical ground reaction force peak based on a ratio of vertical force to horizontal force.

6. The reaction force detection method for treadmills according to claim 4, wherein the electronic carrier is a handheld smart device, a tablet computer, a desktop computer, a panel or a notebook computer.

* * * * *